United States Patent [19]

Harvill

[11] Patent Number: 4,476,912

[45] Date of Patent: Oct. 16, 1984

[54] HOT CHAMBER DIE CASTING MACHINE

[76] Inventor: John I. Harvill, 24201 Orange Ave., Perris, Calif. 92370

[21] Appl. No.: 386,340

[22] Filed: Jun. 8, 1982

Related U.S. Application Data

[63] Continuation of Ser. No. 196,319, Oct. 14, 1980, abandoned.

[51] Int. Cl.[3] ..... B22D 17/04

[52] U.S. Cl. ..... 164/316; 164/113

[58] Field of Search ..... 164/312–318, 164/309–311, 113, 119, 120, 335, 336, 337; 222/385, 596; 266/205, 206

[56] References Cited

U.S. PATENT DOCUMENTS

| | | | |
|---|---|---|---|
| 999,802 | 10/1908 | Van Wagner | 49/182 |
| 1,041,051 | 10/1912 | Engel | 164/316 |
| 1,112,993 | 10/1914 | Dunton | 266/206 X |
| 1,874,721 | 8/1932 | Willis | 164/316 |
| 2,128,129 | 8/1938 | Farley | 266/206 X |
| 2,263,880 | 11/1941 | Jung | 164/337 X |
| 2,602,189 | 11/1945 | Finelt | 425/146 |
| 2,795,021 | 2/1955 | Bax | 164/312 |
| 2,893,082 | 7/1959 | Hodler | 164/315 |
| 2,938,250 | 5/1960 | Larsh et al. | 164/316 X |
| 3,020,607 | 2/1962 | Nyselius | 164/315 |
| 3,201,836 | 8/1965 | Nyselius | 164/312 |
| 3,601,180 | 8/1971 | Nef | 164/315 |
| 4,061,176 | 12/1977 | Carbonnel | 164/312 X |

FOREIGN PATENT DOCUMENTS

| | | | |
|---|---|---|---|
| 51888 | 9/1941 | Netherlands | 164/312 |
| 370332 | of 1931 | United Kingdom . | |
| 395154 | of 1933 | United Kingdom . | |
| 549238 | of 1941 | United Kingdom . | |
| 574213 | of 1945 | United Kingdom . | |

OTHER PUBLICATIONS

Sales Bulletin, "Die Cast Your Product", H. L. Harvill Mfg. Co., Bulletin No. 6, Feb. 1946, pp. 8 & 9.

Sales Bulletin–H. L. Harvill Mfg. Co., p. 2, date unknown but admitted to be prior art.

*Primary Examiner*—Kuang Y. Lin

*Attorney, Agent, or Firm*—Lyon & Lyon

[57] ABSTRACT

A hot chamber die casting machine employing a substantially horizontally arranged charging cylinder and piston. The piston employs a charging head, a sealing head and a rigid member therebetween. The device is arranged to allow access to the piston for changing rings and the like without substantial loss of material from the pot. A safety cover is also provided with doors which do not remain open without external support.

10 Claims, 4 Drawing Figures

HOT CHAMBER DIE CASTING MACHINE

This is a continuation of application Ser. No. 196,319 filed Oct. 14, 1980 so now abandoned.

BACKGROUND OF THE INVENTION

The present invention relates to die casting machinery and specifically hot chamber die casting machinery.

Hot chamber die casting machines generally include a hot chamber or pot in which the material which is to be used in the casting process is contained. This material, which is kept in the molten state, is automatically drawn into a die charging device which is at least partially submerged within the molten metal. Thus, there is not ladling of molten material to the die as with certain other casting processes. The automatic charging is, of course, most advantageous; however, certain limitations are placed on the charging mechanism.

Conventional charging mechanisms generally employ a plunger operating through a vertical cylinder. To direct the casting material to the die from the vertical cylinder, a gooseneck is employed which conveys the material to a position above the level of the molten supply and outwardly over the rim of the pot to the die location. The vertical orientation of the charging cylinder ensures that the driving mechanism is located above the pot so that the plunger may be easily pulled without requiring a first draining of the pot and sealing problems are minimized.

In spite of the advantages associated with the vertical arrangement, certain inherent difficulties also exist. The gooseneck required with a vertically arranged cylinder exhibits a substantial pressure loss with the casting material being forced at sufficient speed to reach all portions of the die quickly. The orientation of the charging cylinder also requires that the gooseneck extend over a substantial distance. This results in a cooling of the charged material prior to its reaching the die if some form of additional heating is not provided. To overcome the cooling problem, the gooseneck does not extend to the die. Instead, a nozzle is provided to span a substantial distance between the gooseneck and the die. The nozzle is then kept warm by means of torches directed at the nozzle. This arrangement better maintains the material at the appropriate temperature but results in the very rapid erosion of the nozzle.

The location of the vertical plunger above the pot which cooperates with the vertical charging cylinder also exhibits an inherent disadvantage in that this mechanism tends to interfere with proper access to the pot of molten material for replenishing the pot and the like. Practical experience has shown that the process required with most conventional systems for replenishing the pot has resulted in the improper removal of the pot covers by workers who are not exercising reasonable care for their own safety. Removal of these covers provides added convenience for the workers in replenishing the pot. However, adding solid material to the molten reservoir can result in splashing and the like which could possibly endanger the worker. Consequently, conventional systems, albeit safe, can be used improperly and thereby endanger the irresponsible worker.

SUMMARY OF THE INVENTION

The present invention is directed to hot chamber die casting machines and employs a substantially horizontal charging cylinder which extends through rather than down into the pot. The horizontal orientation of the cylinder reduces certain of the difficulties associated with vertically oriented charging cylinders. For example, the horizontal cylinder eliminates the pressure loss attributed to the reversal of the charged material required in the gooseneck. Furthermore, the extended distance required for the material to travel through the gooseneck is substantially reduced. As a result, the nozzle extending between the charging device and the die becomes optional rather than mandatory. Finally, with a substantially horizontal charging cylinder the plunger mechanism is no longer positioned above the pot. As a result, a cover may be employed which the careless worker is less likely to remove.

To ensure convenient operation of the charging cylinder and its associated piston, a piston is employed which has two heads spaced axially from one another. The head closest to the die operates as the charging head to force material into the die. The other head is employed as a sealing mechanism to prevent molten material from escaping from behind the charging head and out of the pot.

The charging arrangement of the present invention may also employ a mechanism useful for servicing the piston without requiring a draining of the pot. A pressure relief port rearwardly of the charging head is positioned such that it will become covered over before the sealing head is fully extracted from the charging cylinder. Consequently, only a small amount of molten material will be present or available to escape from behind the charging head when the piston is withdrawn from the charging cylinder. This small amount of material escapes to a gutter which is provided beneath the rear end of the charging cylinder. Because of the small amount of material allowed to escape from the cylinder, the piston may be retracted for servicing of the seals without substantial loss. For such servicing, the piston may be finally retracted to a point where the charging head remains in the charging cylinder only forward of the seals located peripherally about the charging head. Albeit the sealing capacity of the head is reduced as the rings are retracted from the charging cylinder, the condition of the molten material ahead of the charging piston at this time is not under pressure. Thus, the close tolerance of the piston itself within the charging cylinder provides an adequate seal to allow convenient work on the sealing device around the charging head.

A cover having ports therethrough for replenishing of the pot is here employed. The cover includes doors over the ports which are designed to only partially open and to close automatically when not externally propped. In this way, splash is eliminated without the inconvenience which might otherwise tempt a careless worker to remove the cover.

Accordingly, it is an object of the present invention to provide an improved hot chamber die casting machine. Other and further objects and advantages will appear hereinafter.

DETAILED DESCRIPTION OF THE PREFERRED EMBODIMENT

Figure 1:
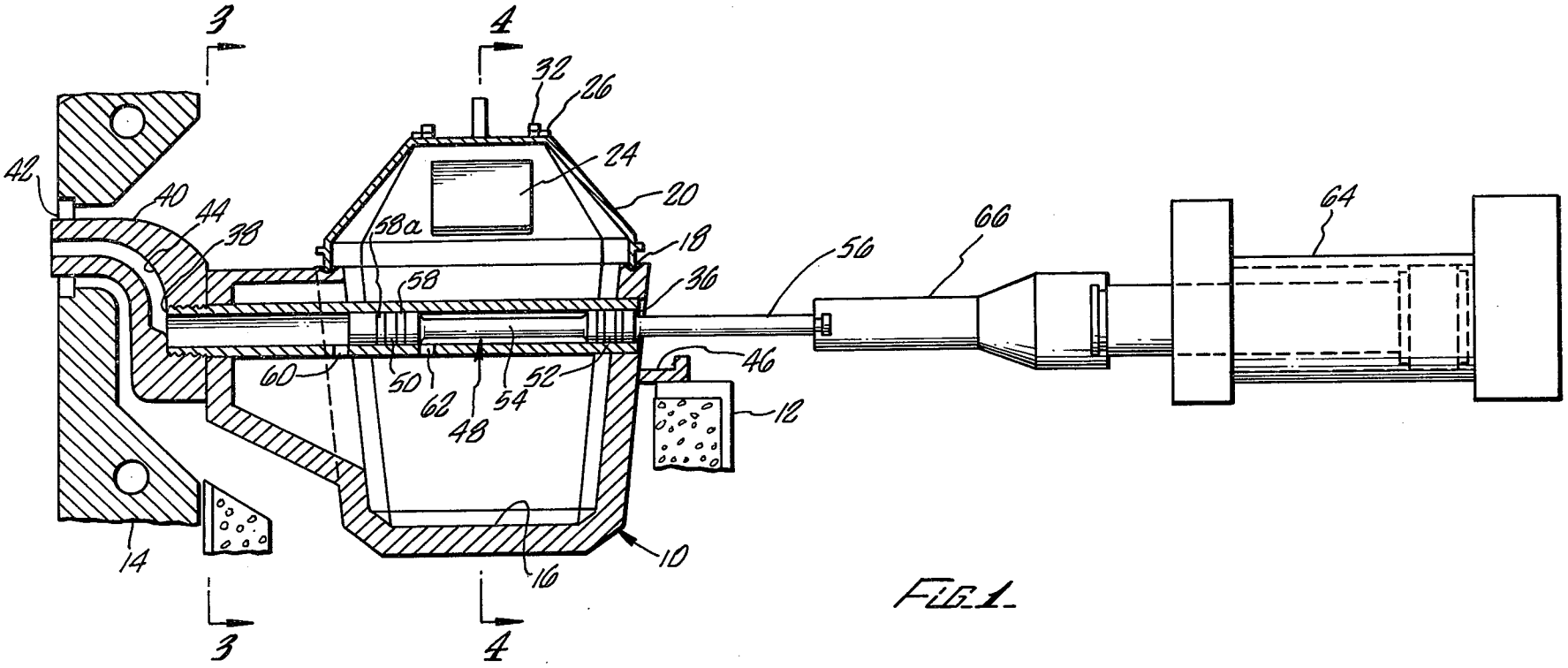
FIG. 1 is a side view of the present invention with the pot and charging cylinder illustrated in vertical cross section.
Figure 2:
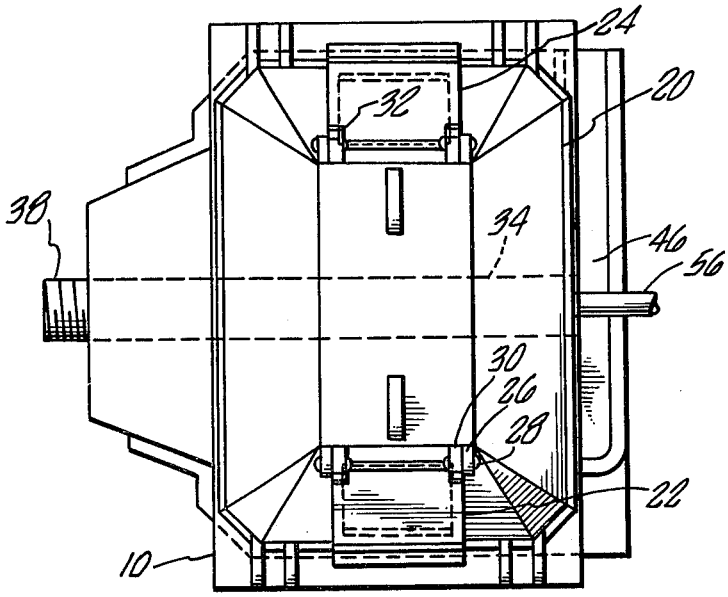
FIG. 2 is a plan view of the present invention.
Figure 3:
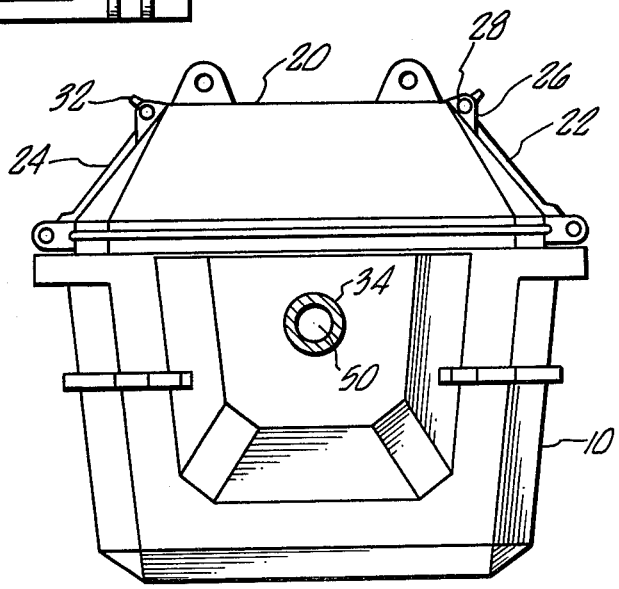
FIG. 3 is a front view of the present invention taken along 3—3 of FIG. 1.

Turning in detail to the drawings, a hot chamber die casting machine is illustrated including a pot 10 shown in position in a furnace 12 and extending to a fixed platen 14. The overall shape of the pot 10 is designed to accommodate existing facilities employing more conventional systems. A central cavity 16 contains the molten material used in the casting process. The central cavity 16 extends forward toward the fixed platen 14 such that the molten material will aide in keeping the forward portions of the mechanism hot. The upper surface of the pot 10 includes a groove 18 for receiving a cover 20. The cover 20 completely encloses the upper portion of the pot 10 and may be arranged to accommodate an inert gas shield therein.

Figure 4:
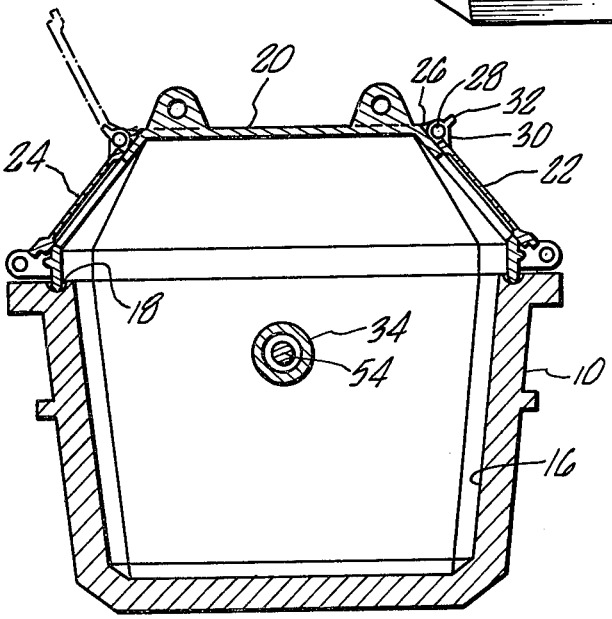
FIG. 4 is a cross-sectional elevation taken along line 4—4 of FIG. 1.

The cover 20 includes access to the pot without removal of the cover through two pivotally mounted doors 22 and 24. The doors are pivotally mounted to lugs 26 by means of pins 28. Two lugs 30 are provided on each door for cooperation with the pins 28 and the lugs 26 on the cover 20. The lugs 30 include stop means in the form of upstanding fingers 32 which interfere with the full pivotal movement of the doors 22 and 24 about the pins 28. The full open condition of the doors 22 and 24 as constrained by the fingers 32 is shown in phantom in FIG. 4. The position of the fingers 32 is such that the center of gravity of the doors 22 and 24 cannot cross over the top of the pins 28 such that the doors would remain open without external propping. Consequently, unless propped, the doors automatically close. The doors are positioned on the cover 20 such that they are accessible from the sides of the pot 10. This of course aids in the facile replenishing of casting material to the pot 10.

Located through the pot 10 in a substantially horizontal position is a charging cylinder 34. The charging cylinder 34 has a first open end 36 extending out of what may be considered the back side of the pot 10. The second or other open end 38 extends from the pot 10 through the forward side thereof. Thus, neither end of the cylinder 34 is located within the pot 10.

The second open end 38 includes a mechanism for attaching a nose 40 thereon. The mechanism illustrated is shown in the present embodiment to be a simple threaded mating of the nose 40 with the end 38 of the charging cylinder 34. The nose 40 extends from the second open end 38 of the charging cylinder 34 upwardly to a position above the fluid level of the material contained within the pot 10 and forwardly to a position at the die inlet 42. The end of the nose 40 is preferably above the upper surface of the pot 10. A passage 44 thus communicates material from within the charging cylinder 34 to the die. The distance covered by the passage 44 is preferably maintained at a minimum to prevent unnecessary cooling of the material passing therethrough. The nose 40 also shares a substantial common interface with the forward side of the pot 10 in order that heat will be conducted from the pot 10 to warm the nose 40.

Located immediately below the first opened end 36 of the charging cylinder 34 is a gutter 46. The gutter 46 is designed to catch and drain off any molten material which might be discharged from the first open end 36 of the charging cylinder 34.

Positioned within the charging cylinder 34 is a piston 48. The piston 48 is employed in the operation of the charging mechanism between a retracted position as shown in FIG. 1 and a forward or extended position when charging of the die is complete. For service of the piston 48, the piston 48 may be withdrawn through the first end 36 of the charging cylinder 34 to an extracted or service position exposing the sealing mechanism as will be discussed below.

The piston 48 includes a first or charging head 50, a second or sealing head 52 and a rigid connecting member 54 between the two heads 50 and 52. The heads 50 and 52 and the rigid connecting member 54 are integrally formed in this embodiment. Also integrally formed with the piston 48 is a connecting rod 56 which is of sufficient length to extend from the first open end 36 of the charging cylinder 34 with the piston 48 in its fully forward position toward the nose 40. The charging head 50 and the sealing head 52 both are sized to fit closely within the charging cylinder 34 and further include sealing means located about the periphery of the heads. The sealing means include rings 58 which provide additional sealing capability particularly for the charging head 50 which experiences substantial fluid pressure from the material being forced into the die. A significant length of the forward end of the charging head 50 is located in front of the first ring **58*a*. This portion of the head 50 in front of the first ring 58*a* is designed to remain within the charging cylinder 34 when in the extracted or service position to help seal the cylinder with the first ring 58*a* exposed for replacement as will be discussed below. Thus, the piston 48 is slidably mounted to closely fit within the charging cylinder 34. The rigid connecting member 54 between the two heads 50 and 52 may be of any appropriate diameter. However, the larger the diameter of this member 54, the less molten material is retained in the annular space between the member 54 and the charging cylinder 34**.

Means are provided for charging the cylinder 34 with molten material. Charging is accomplished through a port 60 in the cylinder wall at a position between the piston 48 and the first open end 36 when the piston is in its retracted position. As the level of molten material within the pot 10 is maintained above cylinder 34, the molten material will flow through port 60 into the interior of the charging cylinder 34 between charging strokes of the piston 48. A second, relief port 62 is provided between the charging head 50 and the sealing head 52. The charging head 50 and the sealing head 52 being spaced far enough apart such that during the normal operation of the piston 48, neither head passes over the relief port 62. The relief port 62 provides pressure relief for any pressurized material flowing around the rings on the charging head 50 due to the pressure induced in the material ahead of the piston 48 when the die is being charged. The relief port 62 is also positioned near the back portion of the charging head 50 so that this port will be covered over fairly quickly as the piston 48 is retracted from the charging cylinder 34.

Connected to the piston 48 is a means for forcing the piston axially to charge the die and to return the piston for successive strokes. This means is provided in the present embodiment by a hydraulic cylinder 64. A rigid link 66 which is removable is positioned between the piston of the hydraulic cylinder 64 and the piston 48. The connecting rod 56 and the piston of the hydraulic cylinder 64 are such that the rigid link 66 may be removed, the piston of the hydraulic cylinder 64 extended and the connecting rod 56 connected directly to the piston of the hydraulic cylinder 64. By then retracting the hydraulic cylinder, the piston 48 is drawn from the charging cylinder 34. By selecting the rigid link 66, full retraction of the hydraulic cylinder 64 will leave the front portion of the charging head 50 in the charging cylinder 34 with the rings 58 fully exposed for replacement. This is accomplished by making the effective length of the rigid link 66 between the couplings at either end equal to the distance between the first end of the charging cylinder 34 on the side of the pot 10 adjacent the hydraulic cylinder 64 and the far side of the leading ring 58*a* on the charging head 50.

Looking then to the operation of the mechanism, the piston 48 normally operates within the charging cylinder 34 such that the sealing head 52 does not leave the charging cylinder 34. As the piston 48 is forced forward, the charge within the forward portion of the charging cylinder 34 is forced to the die. As the piston is retracted back behind the port 60, new material may flow into the charging cylinder 34. As mentioned above, if pressure leakage around the seals of the charging head 50 is present, this pressure is relieved through the relief port 62 and no material ever passes beyond the sealing head 52.

When the piston 48 requires service, the rigid link 66 is removed as mentioned above and the piston 48 is drawn rearwardly from the charging cylinder 34. As this occurs, the sealing head 52 is first to leave the charging cylinder 34. By the time that the seal with the sealing head 52 is lost, the relief port 62 is covered over by the charging head 50. The small amount of molten material around the rigid connecting member 54 then drains into the gutter 46 harmlessly. Further retraction of the piston 48 then exposes the rings 58 on the charging head 50. In this way, the rings on the charging head 50 and on the sealing head 52 may be changed without emptying the pot. The portion of the charging head 50 in front of the rings 58 provides a sufficient seal for this operation. The piston 48 may then be slowly forced forward to its operative position without substantial loss of casting material.

Thus, an improved hot chamber die casting machine is disclosed which avoids the difficulties associated with vertically oriented charging cylinders and provides other advantageous and convenient features. While embodiments and applications of this invention have been shown and described, it would be apparent to those skilled in the art that many more modifications are possible without departing from the inventive concepts herein described. The invention, therefore, is not to be restrictive except by the spirit of the appended claims.

What is claimed is:

1. A hot chamber die casting machine comprising a pot;

a hollow cylinder extending horizontally through said pot and having a first, open end on a first outer side of said pot and a second, open end on a second outer side of said pot;

a nose on the second outer side of said pot in communication with the second end of said cylinder;

a piston slidably mounted in said cylinder;

means for moving said piston axially in said cylinder;

means in said cylinder and located between said piston and said second end with said piston in the retracted position for charging said cylinder with material from said pot; said piston including a charging head, a sealing head and a rigid connecting member therebetween; and a relief port through the wall of said cylinder and in communication with the interior of said pot, said relief port being positioned between said charging head and said sealing head when said piston is positioned for charging said cylinder.

2. The hot chamber die casting machine of claim 1 wherein said charging head and said sealing head have sealing means cooperating with said cylinder.

3. The hot chamber die casting machine of claim 1 wherein said means for charging said cylinder include a port through the wall of said cylinder in communication with the interior of said pot, said port being positioned between said piston and said nose when said piston is positioned for charging said cylinder.

4. The hot chamber die casting machine of claim 1 wherein said piston heads and said rigid connecting member are integrally formed.

5. The hot chamber die casting machine of claim 2 wherein said sealing means include sealing rings about the periphery of said piston heads.

6. The hot chamber die casting machine of claim 12 further comprising a cover sealing said pot, said cover including a pivotally mounted door therein to provide access to said pot, said door including stop means for preventing said door from remaining open without external support.

7. A hot chamber die casting machine comprising a pot;

a hollow cylinder extending horizontally through said pot and having a first, open end on a first outer side of said pot and a second, open end on a second outer side of said pot;

a nose on the second outer side of said pot in communication with the second end of said cylinder;

a piston slidably mounted in said cylinder, said piston including a charging head, a sealing head and a rigid connecting member therebetween, said charging head and said sealing head having sealing means cooperating with said cylinder;

means for moving said piston axially in said cylinder;

means in said cylinder and located between said piston and said second end for charging said cylinder with material from said pot, said means for charging said cylinder including a port through the wall of said cylinder in communication with the interior of said pot, said port being positioned between said piston and said nose when said piston is positioned for charging said cylinder; and a relief port through the wall of said cylinder and in communication with the interior of said pot, said relief port being positioned between said charging head and said sealing head when said piston is positioned for charging said cylinder.

8. The hot chamber die casting machine of claim 7 wherein said relief port is between said charging head and said sealing head during the full charging stroke of said piston.

9. A hot chamber die casting machine comprising a pot;

a cylinder extending horizontally through said pot and having a first, open end on a first outer side of said pot;

a nose on a second outer side of said pot in communication with a second end of said cylinder;

a piston slidably mounted in said cylinder;

means for moving said piston axially in said cylinder;

means for charging said cylinder between said piston and said second end with material from said pot;

said piston including a charging head, a sealing head and a rigid connecting member between said heads, said heads including sealing rings about the periphery thereof, and said means for moving said piston axially includes a removable rigid link coupled with said piston, the effective length of said rigid link being equal to the distance between said first end of said charging cylinder on the side of said pot adjacent said means for moving said piston and the far side of the leading one of said sealing rings on said charging head when said piston is positioned for charging said cylinder; and a relief port through the wall of said cylinder and in communication with the interior of said pot, said relief port being positioned between said charging head and said sealing head when said piston is positioned for charging said cylinder.

10. A hot chamber die casting machine comprising a pot;

a hollow cylinder extending horizontally through said pot and having a first, open end on a first outer side of said pot and a second, open end on a second outer side of said pot;

a nose on the second outer side of said pot in communication with said second end of said cylinder;

a piston slidably mounted in said cylinder including a charging head, a sealing head, and a rigid connecting member therebetween;

means for moving said piston axially in said cylinder;

a port through the wall of said cylinder in communication with the interior of said pot and located between said piston and said second end with said piston in the retracted position for charging said cylinder with material from said pot, said sealing head being located inwardly of the outside of said pot, said sealing head being located inwardly of the outside of said pot with said piston in the retracted position for charging said cylinder with material from said pot; and a relief port through the wall of said cylinder and in communication with the interior of said pot, said relief port being positioned between said charging head and said sealing head when said piston is positioned for charging said cylinder.

* * * * *